United States Patent [19]

Quarella

[11] Patent Number: 4,463,768

[45] Date of Patent: Aug. 7, 1984

[54] APPARATUS FOR FORMING A TOBACCO FILLER

[75] Inventor: Guido Quarella, Escheburg, Fed. Rep. of Germany

[73] Assignee: Hauni-Werke Körber & Co. KG, Hamburg, Fed. Rep. of Germany

[21] Appl. No.: 392,775

[22] Filed: Jun. 28, 1982

[30] Foreign Application Priority Data

Jan. 28, 1982 [DE] Fed. Rep. of Germany ..... 3202805

[51] Int. Cl.[3] ..... A24C 5/04; A24C 5/14; A24C 5/18; A24C 5/39

[52] U.S. Cl. ..... 131/84 B; 131/108; 131/110

[58] Field of Search ..... 131/84 R, 84 A, 84 B, 131/84 C, 108, 110

[56] References Cited

U.S. PATENT DOCUMENTS 4,175,570 11/1979 Heitmann ..... 131/108

*Primary Examiner*—Vincent Millin

*Attorney, Agent, or Firm*—Peter K. Kontler

[57] ABSTRACT

Apparatus is provided for forming a tobacco filler, said apparatus being adapted to ensure gentle transport of a tobacco stream through an arcuate duct in the distributor of a cigarette rod making machine and into a tobacco channel which is located below a rod conveyor. The wall of the arcuate duct is provided with compressed air admitting means which extend along the wall of and into the duct in the direction of transport of the tobacco stream and generate a current advancing along the wall of the duct to entrain and accelerate the tobacco.

9 Claims, 1 Drawing Figure

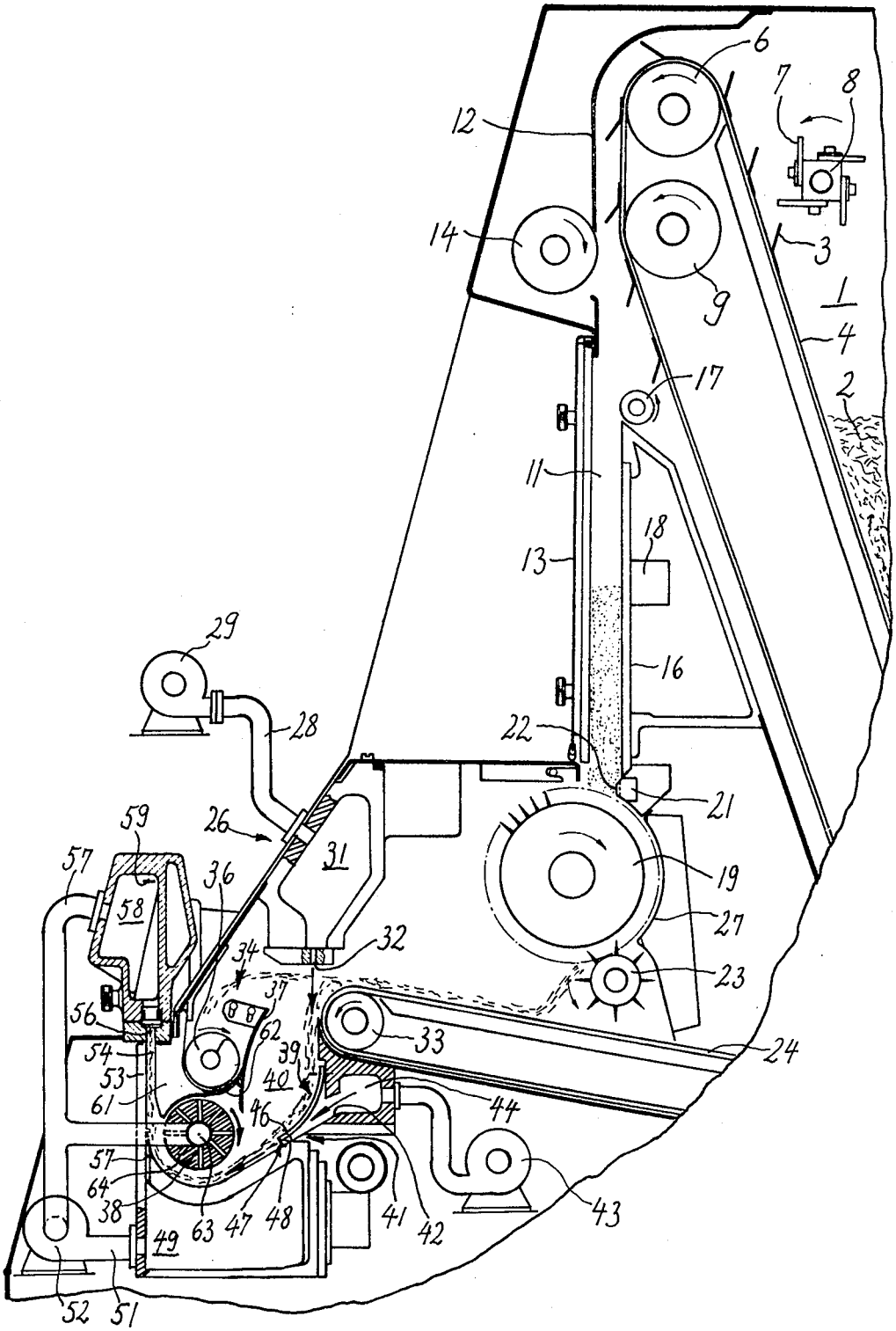
6
7
8
12
14
3
9
1
4
17
2
11
18
13
16
29
28
22
21
59
26
31
19
57
36
58
27
34
32
23
37
56
62
33
24
54
39
53
40
61
46
44
57
64
38
63
47
48
41
42
43
49
52
51

APPARATUS FOR FORMING A TOBACCO FILLER

BACKGROUND OF THE INVENTION

The invention relates to an apparatus for forming a tobacco filler on a moving air-permeable rod conveyor. More specifically, this invention relates to such apparatus where the conveyor is acted upon by suction air and by the closing of a channel which is formed by two side walls located opposite each other, which is preceded by an arcuate duct receiving tobacco from a conveyor means, and through which the tobacco is transported by an accelerating means.

OBJECTS AND SUMMARY OF THE INVENTION

An object of the invention is to provide accelerating means which can transport tobacco gently along the arcuate guide and into the tobacco channel.

In accordance with the invention, this object is accomplished utilizing accelerating means comprising compressed-air feeding means which extends from the wall of the duct therealong in substantial parallelism therewith and immediately adjacent thereto.

The duct is preferably curved in such a way that tobacco can be supplied into the duct from above and can be delivered in an upward direction into the channel. In this manner, the force of gravity assists in accelerating the path of the tobacco whereby, upon receiving the subsequent impulse from the accelerating means, the tobacco is engaged, without transition, by the stream of suction air of the belt conveyor at the upper downstream outlet of the arcuate shaft.

A loose distribution of tobacco during admission into the arcuate shaft is preferably achieved in that the conveyor means for delivery of tobacco constitutes an apron conveyor.

In order to achieve balanced amounts of air, the admitted accelerating air must be withdrawn from the conveyance path of tobacco after it has accomplished its purpose. In accordance with an advantageous embodiment, this is accomplished in that the inner side of the arcuate duct is bounded by a drum whose periphery is formed with suction air openings. Such a drum, which has a smooth peripheral surface, results in the gentle the deflection of tobacco along the underside of the duct and draws the accelerating air through the continually moving suction openings which, in this manner, are automatically held open and kept free of tobacco by centrifugal force.

In accordance with an advantageous embodiment, the full effect of the flow of admitted accelerating air upon entrainment of the supplied tobacco is achieved in that the compressed-air feeding means is provided with a cover which overlies a supply slit in the wall of the duct and conforms to the curvature of and is located at a predetermined distance from such wall. In this manner, one achieves a wall stream which conforms accurately to the outer wall of the duct with optimal transporting effect which is free of eddies.

In accordance with a particularly simple embodiment, the cover constitutes a piece of resilient sheet metal which has distancing projections abutting against the wall of the duct so as to leave open through-flow slits.

The advantage which is achieved with the invention consists in the establishment of an acceleration by a flow of compressed air which immediately follows the acceleration of supplied tobacco and which transports the tobacco gently along the curved outer wall of the duct, such acceleration merging into the acceleration by suction air in the tobacco channel. In this manner, the tobacco is treated very gently.

The invention will be explained in greater detail hereinbelow with reference to the embodiment which is shown in the drawing.

BRIEF DESCRIPTION OF THE DRAWING

The FIGURE is a fragmentary elevational view of a distributor in a cigarette rod making machine, with the sidewall removed.

DETAILED DESCRIPTION OF THE PREFERRED EMBODIMENT

The distributor comprises a magazine 1 for a supply 2 of tobacco from which the tobacco is withdrawn by a steep conveyor 4 comprising entraining elements 3. The upwardly advancing reach of the steep conveyor 4 cooperates with a paddle wheel 8 having leader straps 7 and being disposed below an upper deflecting roll 6. The paddle wheel is connected with the deflecting roll 6 by a non-visible belt drive and serves to brush off the surplus of tobacco from the entraining elements 3 of the steep conveyor 4. Below the deflecting roll 6, there is provided a deflecting roll 9 which effects vertical guidance of the downwardly moving reach of the steep conveyor 4 above a storage duct 11. A guide wall 12, which extends in parallelism with such reach and conforms to the curvature of the deflecting roll 6 in the region adjacent to the deflecting roll 6, constitutes an extension of a front wall 13 of the storage duct 11 and serves for interference-free guidance of tobacco descending into the storage duct 11 from the entraining elements 3 of the steep conveyor 4. The guide wall 12 has a cutout for a rotary magnetic roller 14. Suspension of tobacco shreds on the upper end of a rear wall 16 of the storage duct 11 is prevented by a roller 17 which is mounted at such location and can be driven at a constant RPM.

A monitoring device 18 (several reflection type photocells which are distributed across the width of the storage duct 11 at different levels and are electrically connected with each other, and which transmit signals through time-delay elements only when they are covered for predetermined intervals of time) on the rear wall 16 of the supply duct 11 controls a nonillustrated drive for the steep conveyor 4.

The storage duct 11 discharges above a withdrawing conveyor in the form of a carded drum 19 which can be driven in a clockwise direction by the main drive motor of the rod making machine through an infinitely variable transmission. Tobacco is discharged on the carded drum 19 at the 1-o'clock position. Uniform filling of the carded drum 19 with tobacco from the storage duct 11 is ensured by a strip 21 which oscillates transversely of the carded drum 19, which can be driven in synchronism therewith, which is disposed between the carded drum 16 and the rear wall 16, and which exhibits a profiled projection 22 extending into the storage duct 11.

At the 5-o'clock position, the carded drum 19 cooperates with a picker roller 23 which is driven at a constant RPM in a counterclockwise direction and is disposed above an apron conveyor 24 which can be driven at a constant speed in a direction toward a sifting device 26. Portions of the peripheries of the carded drum 19 and picker roller 23 are overlapped by a shell 27 which extends downwardly all the way to the apron conveyor 24. It should prevent, on the one hand, the escape of tobacco from the carded drum 19 before reaching the picker roller 23 and, on the other hand, it should intercept tobacco which is propelled by the picker roller 23 counter to the direction of transport of the apron conveyor 24.

The apron conveyor 24 is provided with a profiled coating of rubber which should ensure practically slip-free entrainment and transport of tobacco to the sifting device 26.

The sifting device 26 comprises a compressed-air chamber 31 which is connected to the pressure side of a blower 29 by a compressed-air conduit 28 and which discharges a directed air curtain from a row of closely adjacent rectangular openings 32 in a direction transversely of the trajectory of tobacco leaving the apron conveyor 24 at a deflecting roll 33. An intercepting receptacle 34 with a feed screw 36 at the bottom serves to intercept heavy tobacco particles (ribs) which are not deflected, or are deflected only slightly, by the air curtain. The position of a wall 37 between the deflecting roll 33 and the intercepting receptacle 34 is adjustable so that it can influence the sifting action of the sifting device 26. The curvature of the wall 37 is such that tobacco particles which impinge thereagainst slide therealong and reach a deflecting drum 38 which rotates in a clockwise direction and which is adapted to be driven at a constant RPM. The wall 37, the deflecting drum 38 and a wall 39 located opposite the wall 37 define a sifting duct 40 for interception of tobacco which is deflected from its original path by the air curtain. The duct wall 39, whose curvature conforms to that of the deflecting drum 38 and which is guided along and spaced apart from the underside of the deflecting drum 38, is provided with compressed-air feeding means 41 which constitutes a tobacco accelerating means. The compressed-air feeding means 41 comprises a supplying slit 42 provided in the duct wall 39 and connecting the sifting duct 40 with a plenum chamber 44 which is connected with the pressure side of a blower 43.

To this end, the supplying slit 42 is covered by a cover in the form of a piece of resilient sheet metal 46 whose curvature conforms to that of the duct wall 39 and whose free end has distancing projections 48 abutting against the duct wall 39 by leaving free the air-transmitting slit 47.

That side of the duct wall 39 opposite the sifting duct contains in the region below the deflecting drum 38, the compressed-air chamber 49. Chamber 49 is connected with the pressure side of a blower 52 by a compressed-air conduit 51. In the region where chamber 49 merges tangentially into a wall of the tobacco channel 54, it comprises air channels 57 which are inclined in the direction of transport of an air-permeable rod conveyor 56 which encloses a tobacco channel 54 from above (details can be found in applicant's U.S. Pat. No. 4,175,570). Metallic or ceramic pins 59 are provided to support the rod conveyor 56 in a suction chamber 58 which is connected to the suction side of the blower 52 by a suction conduit 57. A wall 61 of the tobacco channel 54, which is located opposite the wall 53, covers the deflecting drum 38 from above. The wall 61 further constitutes the bottom for the feed screw 36 and is provided with holes which are disposed in the region adjacent to the wall 37 and constitute a sieve 62.

The deflecting drum 38 constitutes a hollow drum, and its hollow core constitutes a suction chamber 63 which extends centrally through and from the one to the other end of the deflecting drum 38. On the one hand, the suction chamber 63 is connected with the suction side of the blower 52 by a suction conduit 64 and, on the other hand, it is connected to chambers in the form of the tobacco channel 54 and sifting duct 40 which are tangential to the periphery of the deflecting roll 38, by openings in the form of air-withdrawing bores 64 provided in the wall of the deflecting drum 38, extending radially therethrough and distributed uniformly along its periphery.

The mode of operation of the distributor is as follows:

The steep conveyor 4 continuously draws tobacco from the tobacco supply 2, whereby successive entraining elements 3 entrain small batches of tobacco. Such batches of tobacco are equalised by the paddle wheel 8 in that tobacco which extends beyond the entraining elements 3 is swept away by the leather straps 7 of the paddle wheel 8. Tobacco descends from the entraining elements 3 of the steep conveyor 4 between the deflecting rolls 6 and 9, and the guide means of the steep conveyor 4, which is vertical at such location, ensures complete evacuation of tobacco. The guide wall 12 directs the tobacco, which is propelled thereagainst, centrally into the storage duct 11 whereby the magnetic roller 14 segregates iron particles which might be contained in the tobacco. The monitoring device 18 monitors the level of tobacco in the storage duct 11 and regulates the steep conveyor 4 in a sense to maintain the tobacco level at a constant value (the RPM of the drive for the steep conveyor 4 is regulated stepwise in accordance with the number of photocells which are covered by tobacco). The carded drum 19 is filled with tobacco at the outlet of the storage duct 11 whereby, on the one hand, the profiled projection 22 of the oscillating smoothing strip 21 ensures uniform filling of the carded drum 19 in that the smoothing strip 21 forces tobacco between the pins of the carded drum 19 and, on the other hand, the strip 21 maintains the tobacco in the lower region of the storage duct 11 in constant motion so that it can readily descend.

The shell 27 prevents escape of tobacco from the carded drum 19 during transport to the picker roller 23. If desired, the shell can terminate in a conventional comb at the inlet region of the picker roller 23. The picker roller 23 expels tobacco from the pins of the carded drum 19 and propels it on to the apron conveyor 24. Longer tobacco shreds normally remain suspended on the pins of the picker roller 23 somewhat longer so that they reach the apron conveyor 24 ahead of the smaller tobacco particles. As will be described below, this is of advantage for the next-following sifting operation. The shell 27, which extends all the way down to the apron conveyor 24, intercepts tobacco shreds which are propelled too far in the rearward direction.

The tobacco carpet which is formed on the apron conveyor 24 is propelled into the sifting device 26 at a predetermined speed, whereby the particles of tobacco enter the range of the air curtain which issues from the openings 32. Heavy tobacco particles (larger portions of ribs) advance across the air curtain and reach the intercepting receptacle 34. It is of advantage for the sifting operation that the longer tobacco shreds are located in the lower region of the tobacco carpet so that they do not interfere with propulsion of heavy tobacco particles into the intercepting receptacle 34. All other tobacco particles are deflected from their conveyance paths to a greater or lesser extent by the air streams issuing from the openings 32 and reach, under the influence of gravity, the sifting duct 40 which is formed by the walls 37 and 39 to the entrained, after a short downward movement in the region of the arcuate duct wall 39, by the air flow issuing from the through-flow slits 47 in the arcuate duct wall 39 and to be propelled into the tobacco channel 54 by advancing along the arcuate duct wall 39.

Heavy tobacco particles, which are propelled into the intercepting receptacle 34, are transported away by the rib feed screw 36 whereby the useful particles, e.g., short ribs known as "birds' eyes", can fall through that portion of the wall 61 which constitutes the sieve 62 and such particles can reach the deflecting drum 38.

During entry into the tobacco channel 54, tobacco is entrained by air streams which issue from the air channels 57 and flow in the direction of transport of the rod conveyor 56, whereby the tobacco receives a component of movement in the direction of transport of the rod conveyor 56 so that it undergoes negligible acceleration in such direction when it impinges upon the belt conveyor 56 which is under the action of suction air or upon tobacco which already adheres to the conveyor 56. Sifting air which flows from the openings 32, as well as accelerating air which issues from the flow-through slits 47 in the duct wall 39, are evacuated primarily through the air-withdrawing bores 64 of the deflecting drum 38. The remainder of air which enters the tobacco channel 54 is sucked through the rod transporting conveyor 56 into the suction chamber 58, together with air which is blown through the channels 57, whereby such air also serves to hold tobacco on the rod transporting conveyor. In this manner, one ensures a balancing of the amounts of air in the corresponding region of the distributor.

I claim:

1. Apparatus for forming a tobacco filler, comprising an arcuate duct having a wall; conveyor means for advancing and delivering tobacco to said duct; and accelerating means for transporting the thus delivered tobacco through said duct, comprising a source of compressed air and means for introducing compressed air from said source into said duct in substantial parallelism with said wall so that the compressed air entrains tobacco through said duct by conveying tobacco close to and along said wall.

2. Apparatus according to claim 1, wherein said conveyor means is arranged to deliver tobacco to said duct from above.

3. Apparatus according to claim 1, further including a channel including two opposite sidewalls and arranged to receive tobacco from said duct under the action of said accelerating means.

4. Apparatus according to claim 3, wherein said channel is located at a level above said arcuate duct so that tobacco passing through said channel advances in an upward direction.

5. Apparatus according to claim 1, wherein said conveyor means comprises an apron conveyor.

6. Apparatus according to claim 1, wherein said wall has a slit for admission of compressed air into said duct and said means for introducing compressed air includes a cover which overlies said slit.

7. Apparatus according to claim 6, wherein said wall is curved and said cover conforms to the curvature of said wall and is disposed at a predetermined distance from said wall.

8. Apparatus according to claim 6, wherein said cover comprises a sheet including projections abutting against the wall of said duct in order to form a plurality of flow-through slits between said wall and said cover.

9. Apparatus for forming a tobacco filler, said apparatus including conveyor means for advancing and delivering tobacco to an arcuate duct; accelerating means for transporting the thus delivered tobacco through said duct, including means contained on a wall of said duct for introducing compressed air into said duct in a direction substantially parallel to said wall; and a deflecting drum in said duct, said drum having at least one suction opening.

* * * * *